US011889919B2

(12) United States Patent
Meusburger et al.

(10) Patent No.: US 11,889,919 B2
(45) Date of Patent: Feb. 6, 2024

(54) DRAWER PULL-OUT GUIDE

(71) Applicant: Julius Blum GmbH, Hoechst (AT)

(72) Inventors: Marc Meusburger, Egg (AT); Pascal Berchtold, Alberschwende (AT)

(73) Assignee: Julius Blum GmbH, Hoechst (AT)

( * ) Notice: Subject to any disclaimer, the term of this patent is extended or adjusted under 35 U.S.C. 154(b) by 633 days.

(21) Appl. No.: 17/108,442

(22) Filed: Dec. 1, 2020

(65) Prior Publication Data

US 2021/0076819 A1 Mar. 18, 2021

Related U.S. Application Data

(63) Continuation of application No. PCT/AT2019/060153, filed on May 7, 2019.

(30) Foreign Application Priority Data

Jun. 5, 2018 (AT) ..... A 50449/2018

(51) Int. Cl.
*A47B 88/437* (2017.01)
*A47B 88/487* (2017.01)
*A47B 88/407* (2017.01)

(52) U.S. Cl.
CPC ..... *A47B 88/437* (2017.01); *A47B 88/407* (2017.01); *A47B 88/487* (2017.01);
(Continued)

(58) Field of Classification Search
CPC ... A47B 88/437; A47B 88/487; A47B 88/407; A47B 2210/0037; A47B 2210/0054
See application file for complete search history.

(56) References Cited

U.S. PATENT DOCUMENTS 1,849,809 A 3/1932 Showers
4,291,929 A * 9/1981 Faust ..... A47B 88/43 312/334.17

(Continued)

FOREIGN PATENT DOCUMENTS

CH 693 225 4/2003
CN 105078028 11/2015

(Continued)

OTHER PUBLICATIONS

Search Report dated Sep. 7, 2021 in corresponding Chinese Patent Application No. 201980037157.2.

(Continued)

*Primary Examiner* — Daniel J Rohrhoff
(74) *Attorney, Agent, or Firm* — Wenderoth, Lind & Ponack, L.L.P.

(57) ABSTRACT

A drawer pull-out guide includes a first guide rail and a second guide rail displaceably supported relative to one another. A supporting element is arranged on the first guide rail, and the supporting element is configured to be supported, at least temporarily, on the second guide rail. A position of the supporting element relative to the second guide rail can be adjusted by an adjustment device, and, after adjustment has been made, can be fixed relative to the first guide rail. The at least one supporting element can be adjusted in a height direction, seen in the mounted position of the drawer pull-out guide, by the adjustment device.

14 Claims, 6 Drawing Sheets

(52) U.S. Cl.
CPC ..... *A47B 2210/0037* (2013.01); *A47B 2210/0054* (2013.01)

(56) References Cited

U.S. PATENT DOCUMENTS

| | | | | | |
|---|---|---|---|---|---|
| 4,842,422 | A * | 6/1989 | Nelson | A47B 88/407 | 384/57 |
| 5,556,182 | A * | 9/1996 | Lai | A47B 88/487 | 312/334.7 |
| 5,692,816 | A * | 12/1997 | Lai | A47B 88/487 | 312/348.1 |
| 6,923,518 | B2 * | 8/2005 | Kim | A47B 88/423 | 312/334.7 |
| 7,226,139 | B2 | 6/2007 | Salice | | |
| 8,919,711 | B2 | 12/2014 | Holzer et al. | | |
| 9,788,654 | B1 * | 10/2017 | Chen | A47B 88/403 | |
| 2002/0043914 | A1 * | 4/2002 | Munday | A47B 88/487 | 312/334.7 |
| 2003/0234603 | A1 * | 12/2003 | Salice | A47B 88/407 | 312/334.5 |
| 2012/0292465 | A1 | 11/2012 | Holzer et al. | | |
| 2019/0216219 | A1 * | 7/2019 | Chen | A47B 88/407 | |

FOREIGN PATENT DOCUMENTS

| | | | | |
|---|---|---|---|---|
| DE | 28 09 930 | | 9/1979 | |
| DE | 28 51 305 | | 6/1980 | |
| DE | 30 15 351 | | 1/1981 | |
| DE | 198 46 778 | | 4/1999 | |
| DE | 19846778 | A1 * | 4/1999 | A47B 88/42 |
| DE | 20211803 | | 9/2002 | |
| DE | 202006010785 | U1 * | 11/2006 | A47B 88/40 |
| DE | 20 2008 012 998 | | 4/2010 | |
| DE | 20 2010 009 163 | | 2/2012 | |
| DE | 20 2012 010 757 | | 3/2014 | |
| EP | 1 190 646 | | 3/2002 | |
| EP | 2 428 136 | | 3/2012 | |
| GB | 2205732 | A * | 12/1988 | A47B 88/0407 |
| JP | 49-16220 | | 2/1974 | |
| JP | 6-44442 | | 6/1994 | |
| JP | 2004-16825 | | 1/2004 | |
| JP | 2013-518623 | | 5/2013 | |
| WO | 2011/094776 | | 8/2011 | |
| WO | 2012/002041 | | 1/2012 | |

OTHER PUBLICATIONS

International Search Report dated Jul. 9, 2019 in International (PCT) Application No. PCT/AT2019/060153.

* cited by examiner

DRAWER PULL-OUT GUIDE

BACKGROUND OF THE INVENTION

The present invention relates to a drawer pull-out guide, including a first guide rail and at least one second guide rail displaceably supported relative to one another. At least one supporting element is arranged on the first guide rail, and the at least one supporting element is configured to be supported, at least temporarily, on the second guide rail. A position of the at least one supporting element relative to the second guide rail can be adjusted by an adjustment device, and, after adjustment has been made, can be fixed relative to the first guide rail.

The invention further concerns a method for mounting a supporting element to a drawer pull-out guide.

Drawer pull-out guides are disclosed in DE 20 2010 009 163 U1, DE 28 09 930 A1, DE 30 15 351 A1 and DE 20 2012 010 757 U1.

Drawer pull-out guides usually include a first guide rail (carcass rail) configured to be fixed to a furniture carcass and at least one second guide rail (drawer rail) configured to be displaceable relative to the first guide rail. Optionally, for obtaining a full extension of the drawer relative to a furniture carcass, an additional third guide rail (central rail) may be provided, the third guide being displaceable between the first guide rail and the second guide rail.

In order to reduce a tilting play between the guide rails, at least one supporting element, for example in the form of a rotatable supporting roller, is usually fixed to the first guide rail. As a result, the second guide rail can be supported on the supporting element of the first guide rail. This supporting element is also beneficial when at least one running carriage with load-transmitting rolling bodies is displaceably supported between the guide rails. This running carriage namely acts as a pivot bearing between the guide rails, and the guide rail to be supported is therefore tiltably mounted, so to say as a two-armed lever, about an axis formed by the running carriage. When the front-end region of the guide rail to be supported is subjected to a load (in particular by a heavy front panel of the drawer), the front-end region of the guide rail is lowered, whereas the rear-end region of the guide rail is elevated due to the pivot bearing formed by the running carriage.

Due to component tolerances of the guide rails and/or of the supporting element, the precise arrangement of the supporting element is connected with several challenges when producing the drawer pull-out guide. If the play between the supporting element and the guide rail to be supported thereon is too less, the friction is increased. In an extreme case, this may lead to a jam between the supporting element and the guide rail. On the contrary, if the play is dimensioned too large, the guide rails, in an open position of the drawer pull-out guide, are tiltable relative to one another beyond a tolerable level. This can eventually lead to the fact that the front-end region of the drawer sags downwardly in the mounted condition. This, however, conveys the impression of a drawer pull-out guide having a poor quality.

SUMMARY OF THE INVENTION

It is an object of the present invention to propose a drawer pull-out guide mentioned in the introductory part, thereby avoiding the above-discussed drawbacks.

According to the invention, the at least one supporting element can be adjusted in a height direction, seen in the mounted position of the drawer pull-out guide, by the adjustment device.

Accordingly, an adjustment device for adjusting the play between the supporting element and the guide rail to be supported thereon is provided, so that the supporting element can be positioned at a predetermined position relative to the second guide rail and can be fixed relative to the first guide rail.

The guide rails are displaceable relative to one another between a closed position and an open position. The at least one supporting element, at least in the closed position, has a play in relation to the second guide rail, and the play can be adjusted by the adjustment device. The closed position of the drawer pull-out guide is present when the guide rails substantially fully overlap one another.

According to an embodiment, the play in the open position of the guide rails is smaller than in the closed position, and/or the at least one supporting element in the open position of the guide rails bears against the second guide rail without play.

According to a preferred embodiment, the adjustment can be performed such that the supporting element is initially moved in a first movement direction so as to abut against the guide rail to be supported (reference value having a play equal to zero). Subsequently, the supporting element is again moved back in a second movement direction, opposite the first movement direction, by a predetermined amount (for example by 0.1 mm), so that the supporting element is positioned with a predetermined play relative to the guide rail to be supported. Alternatively, the adjustment can also be effected by measuring. The at least one supporting element, during normal operation of the drawer pull-out guide (that is to say upon a relative movement of the guide rails to one another), is arranged so as to be stationary relative to the first guide rail.

For fixing the position of the supporting element after adjustment, various possibilities can be provided. Either the adjustment device is configured so as to be sufficiently self-locking on its own, so that the position of the supporting element always remains in the position as previously adjusted. Alternatively or in addition, it can be provided that the position of the at least one supporting element, after adjustment, can be, preferably releasably, fixed by a securing element, and/or that the position of the at least one supporting element, after adjustment, can be permanently fixed, preferably by welding, bonding or tumbling.

For adjusting the play, the supporting element can be movably supported along a guide, and the supporting element, after adjustment along the guide, can be fixed relative to the first guide rail in a force-locking manner (for example by a clamping screw).

Alternatively, the adjustment device includes at least one movably-mounted adjustment element, and the position of the at least one supporting element can be adjusted by an actuation of the adjustment element. For example, the adjustment element can be rotationally supported, and the position of the supporting element can be adjusted by rotating the adjustment element. For this purpose, the adjustment element can have a receiving device for a tool, preferably a screwdriver, and the position of the supporting element can be adjusted by rotating the receiving device with the aid of the tool.

The adjustment element can include a rotatably supported eccentric or a rotationally supported worm wheel. The worm wheel, as already known, can be provided with a spiral-shaped guide track, and a tooth arrangement connected to the supporting element is configured to engage into the spiral-shaped guide track of the worm wheel.

According to an embodiment, the second guide rail includes a side limb and a transverse limb connected to the side limb, and the at least one supporting element, in the mounted position of the drawer pull-out guide, is arranged to be supported on an underside of the transverse limb of the second guide rail. Moreover, the supporting element can be configured to run along the transverse limb of the second guide rail upon a relative movement of the guide rails to one another. The transverse limb of the second guide rail can be configured so as to be flat over the entire length.

For example, the supporting element can be configured as a rotatably mounted supporting roller. The supporting roller, in a mounted position of the drawer pull-out guide on the furniture carcass, can be pivotally supported about a horizontally extending axis. Instead of the supporting roller, an adjustable bearing block for supporting the second guide rail may also be provided.

According to a further embodiment, the at least one supporting element is arranged on the rear-end region of the first guide rail.

The method according to the invention for mounting a supporting element to a drawer pull-out guide is characterized by the following steps:

- arranging the supporting element on the first guide rail of the drawer pull-out guide,
- adjusting the supporting element at a predetermined position relative to the second guide rail with the aid of the adjustment device, and
- fixing the supporting element relative to the first guide rail.

During execution of the method, the supporting element, for adjusting the predetermined position, is moved as long in a first movement direction until the supporting element abuts against the second guide rail, and is then moved in a second movement direction, opposite the first movement direction, until the predetermined position is reached.

BRIEF DESCRIPTION OF DRAWINGS

Further details and advantages of the present invention will be evident from the following description with respect to the drawings, in which.

DETAILED DESCRIPTION OF INVENTION

Figure 1:
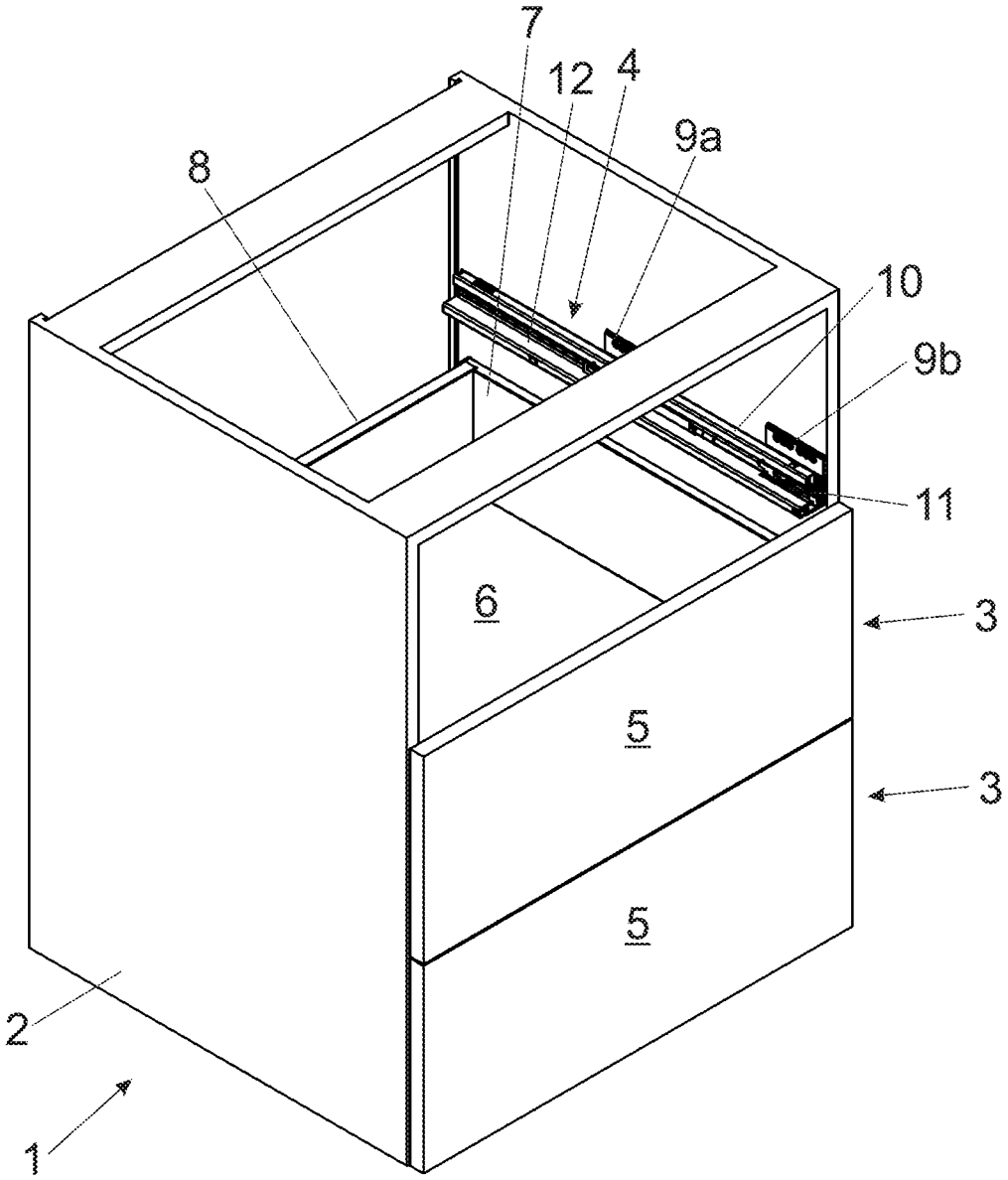
FIG. 1 is a perspective view of an item of furniture having a furniture carcass and drawers displaceable relative thereto.

FIG. 1 shows an item of furniture 1 having a cupboard-shaped furniture carcass 2, and drawers 3 are displaceably supported relative to the furniture carcass 2 by drawer pull-out guides 4. The drawers 3 include a front panel 5, a drawer bottom 6, drawer sidewalls 7 and a rear wall 8. The drawer pull-out guides 4 include at least two guide rails 10, 11, 12 configured to be displaceable relative to one another. In the shown embodiment, a first guide rail 10 (drawer rail) is connected or is configured to be connected to the drawer sidewall 7. A second guide rail 11 (central rail) is displaceably supported between the first guide rail 10 and a third guide rail 12 to be fixed to the furniture carcass 2. The third guide rail 12 includes fastening sections 9*a* and 9*b* for mounting the drawer pull-out guide 4 to the furniture carcass 2.

Figure 2A:
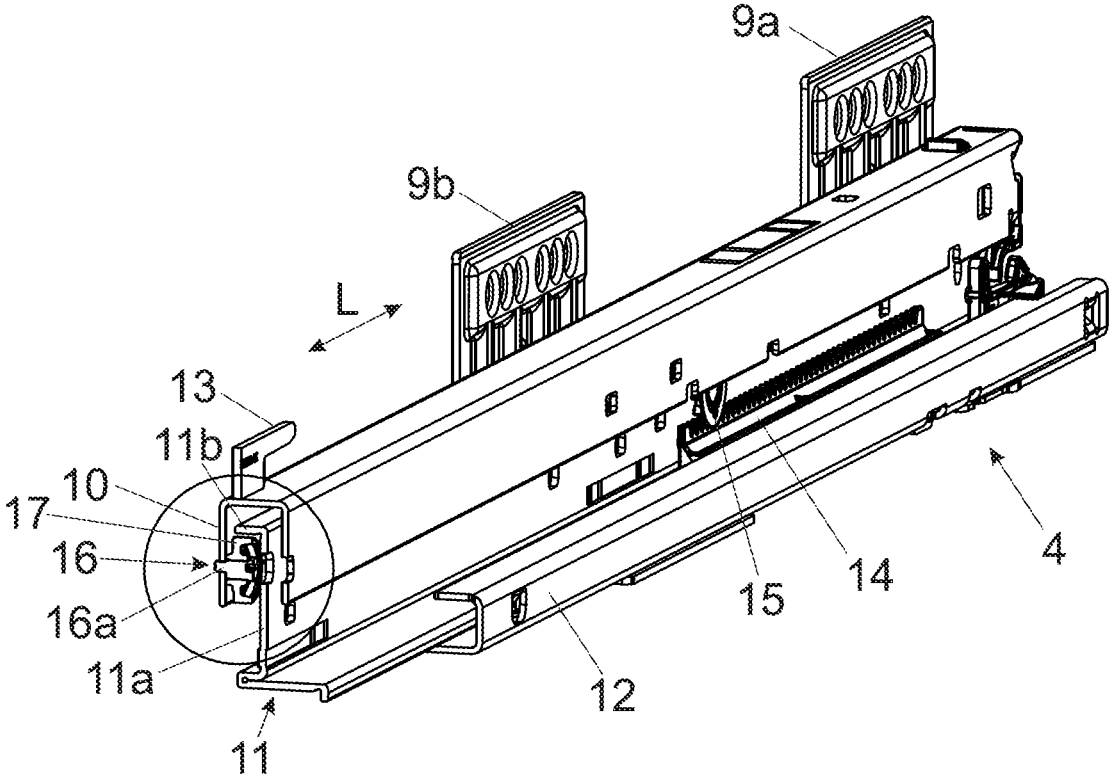
FIG. 2*a*, 2*b* show the drawer pull-out guide in a perspective cross-sectional view and an enlarged detail view thereof.

FIG. 2*a* shows the drawer pull-out guide 4 in a perspective cross-sectional view. A hook 13 is arranged on the rear-end of the first guide rail 10, the hook 13 engaging in a corresponding recess of the rear wall 8 or of the drawer sidewall 7 in a mounted condition of the drawer 3 on the drawer pull-out guide 4. As a result, the rear-end portion of the drawer 3 can be stabilized in a direction extending transversely to the longitudinal direction (L). A first running carriage 18 (not visible here, see FIG. 3*c*) having load-transmitting rolling bodies 18*a* is displaceably supported between the first guide rail 10 and the second guide rail 11. A movement of the first running carriage 18 can be synchronized with a movement of a second running carriage 19 (FIG. 3*a*) by a pinion 15 rotatably mounted on the second guide rail 11, the second running carriage 19 being displaceably supported between the third guide rail 12 (carcass rail) and the second guide rail 11 (central rail). The pinion 15 meshes with a first toothed rack of the first running carriage 18 on the one hand, and with a second toothed rack 14 of the second running carriage 19 on the other hand. At least one supporting element 17 for supporting the second guide rail 11 is arranged on the rear-end region of the first guide rail 10. For adjusting a position of the supporting element 17, an adjustment device 16 with a movably-mounted adjustment element 16*a* is provided. A position of the supporting element 17 can be adjusted by an actuation of the adjustment element 16*a*. The second guide rail 11 includes a side limb 11*a* and a transverse limb 11*b* connected to the side limb 11*a*, and the supporting element 17 is arranged to be supported on an underside of the transverse limb 11*b* of the second guide rail 11. In the shown figure, the supporting element 17 is configured as a supporting roller. Preferably, the supporting roller is rotatably mounted about a horizontally extending axis in the mounted position.

Figure 2B:
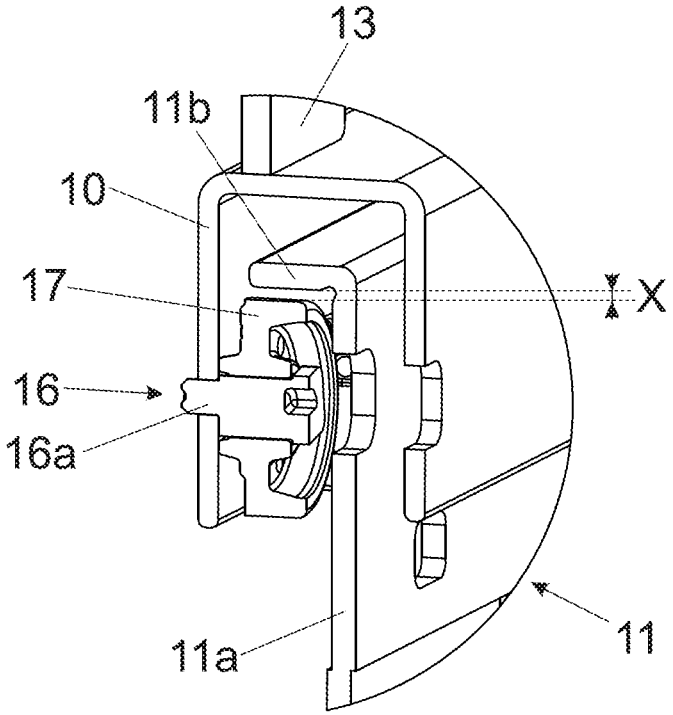

FIG. 2*b* shows the encircled region of FIG. 2*a* in an enlarged view, in which the play (X) between the supporting element 17 and the transverse limb 11*b* of the second guide rail 11 is visible. In the shown FIG. 2*b*, the play (X) is dimensioned too large, so that the second guide rail 11 can unduly be tilted about an axis extending transversely to the longitudinal direction (L). By rotating the adjustment element 16*a* of the adjustment device 16, the play (X) can be adjusted to a predetermined value. For this purpose, the adjustment element 16*a* is rotated as long in a first rotational direction, until the supporting element 17 contacts the underside of the transverse limb 11*b* (play equal to zero). Subsequently, the adjustment element 16*a* is rotated in a second rotational direction, opposite the first rotational direction, until the play (X) has a predetermined value. This can be automatically done in the factory by an assembly robot. After adjustment of the play (X), the supporting element 17 is fixed in its position, for example welded, bonded or tumbled.

Figure 3A:
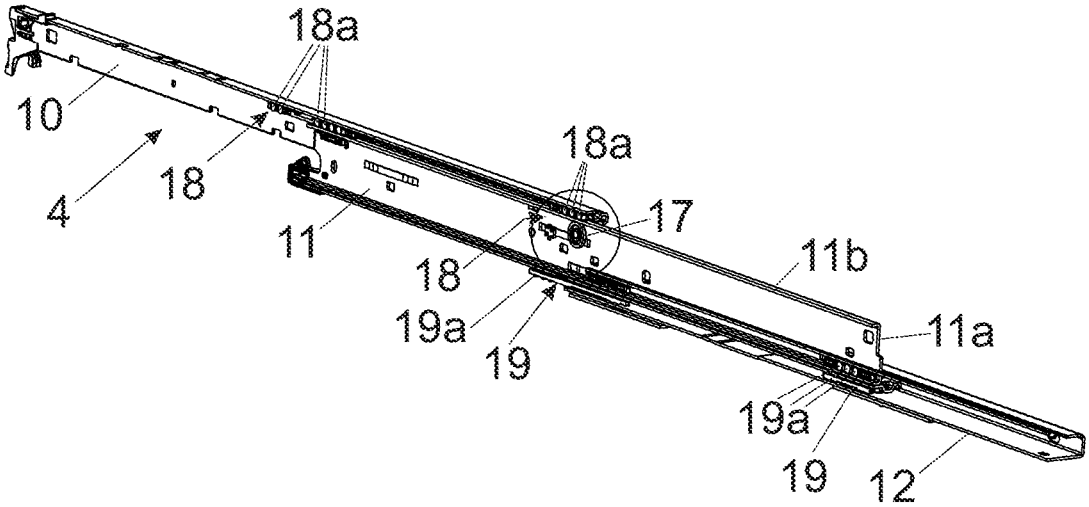
FIG. 3*a*-3*c* show the drawer pull-out guide in a perspective cross-sectional view and two detail views with a different height position of the supporting element.

FIG. 3*a* shows the drawer pull-out guide 4 in a perspective cross-sectional view, in which at least one running carriage 18 with load-transmitting rolling bodies 18*a* is displaceably arranged between the first guide rail 10 and the second guide rail 11. At least one second running carriage 19 with load-transmitting rolling bodies 19*a* is also arranged between the third guide rail 12 and the second guide rail 11. The transverse limb 11*b* of the second guide rail 11 can extend substantially over an entire length of the second guide rail 11.

Figure 3B:
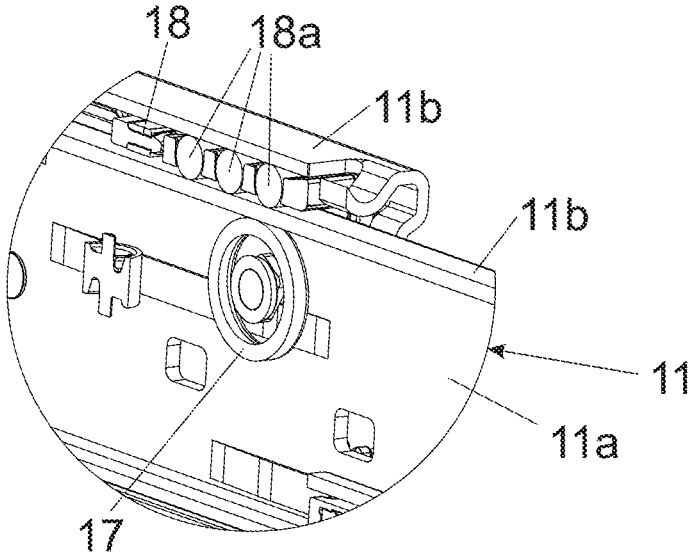

FIG. 3*b* shows the encircled region of FIG. 3*a* in an enlarged view. By an actuation of the adjustment element 16*a*, the supporting element 17 has been moved, starting from the position according to FIG. 2*b*, as long as the supporting element 17 abuts against the second guide rail 11, preferably against the underside of the transverse limb 11*b* of the second guide rail 11. The play (X) is therefore equal to zero and constitutes a reference value for the subsequent adjustment operation.

Figure 3C:
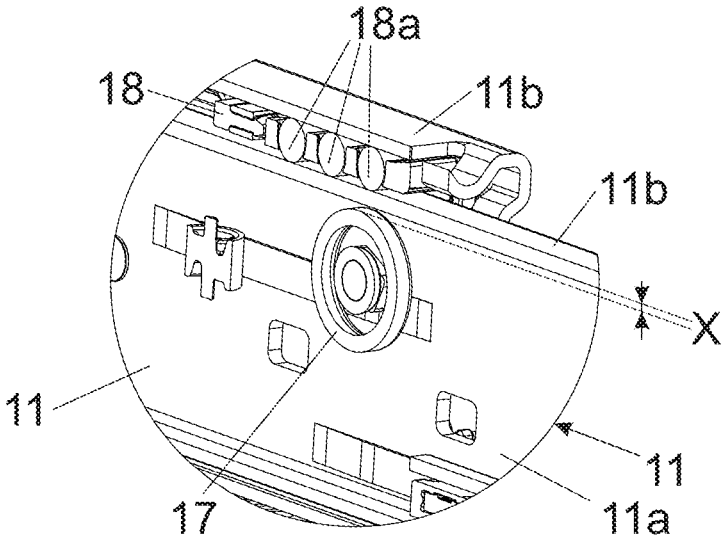

For a correct adjustment of the play (X), the adjustment element 16*a*, starting from the position of the supporting element 17 according to FIG. 3*b*, is adjusted as long in the opposite direction until the play (X) occurring between the supporting element 17 and the second guide rail 11 has a predetermined value (for example 0.1 mm). That position is shown in FIG. 3*c*. The relative position of the supporting element 17 is being held either in a self-locking manner. However, the relative position of the supporting element 17 can be fixed by an additional securing element and/or can be permanently fixed.

Figure 4A:
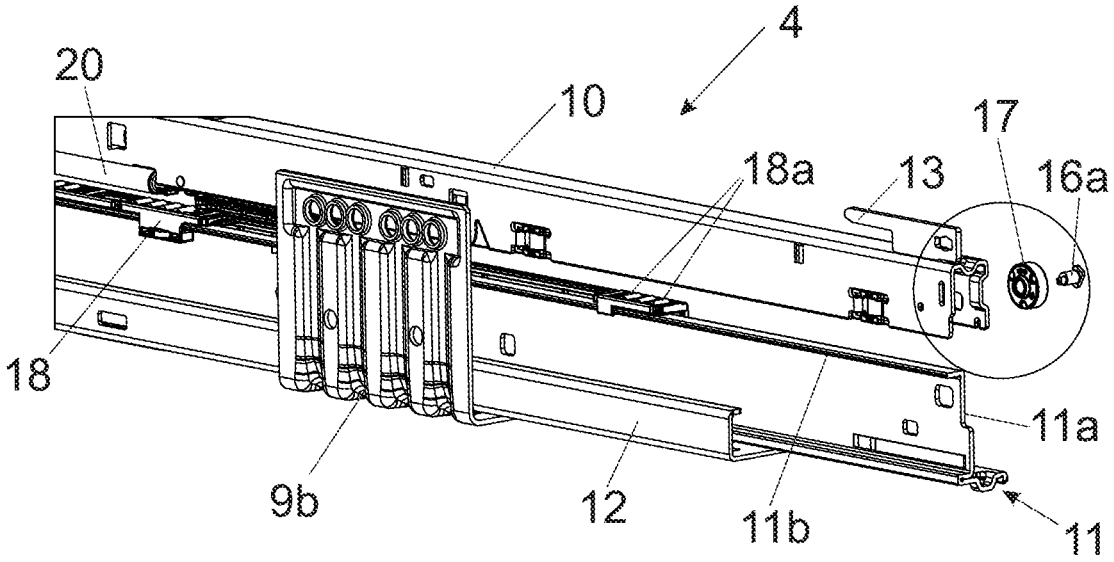
FIG. 4*a*, 4*b* show the rear-end region of the drawer pull-out guide in an exploded view and an enlarged detail view thereof.

FIG. 4*a* shows the rear-end portion of the drawer pull-out guide 4 in an exploded view, in which the first running carriage 18, configured to be displaceable between the first guide rail 10 and the second guide rail 11, with the load-transmitting rolling bodies 18*a* and a retraction device 20 for retracting the first guide rail 10 into a closed end position can be seen. The retraction device 20 may include a, preferably hydraulic, damping device for dampening the spring-assisted retraction movement of the first guide rail 10.

Figure 4B:
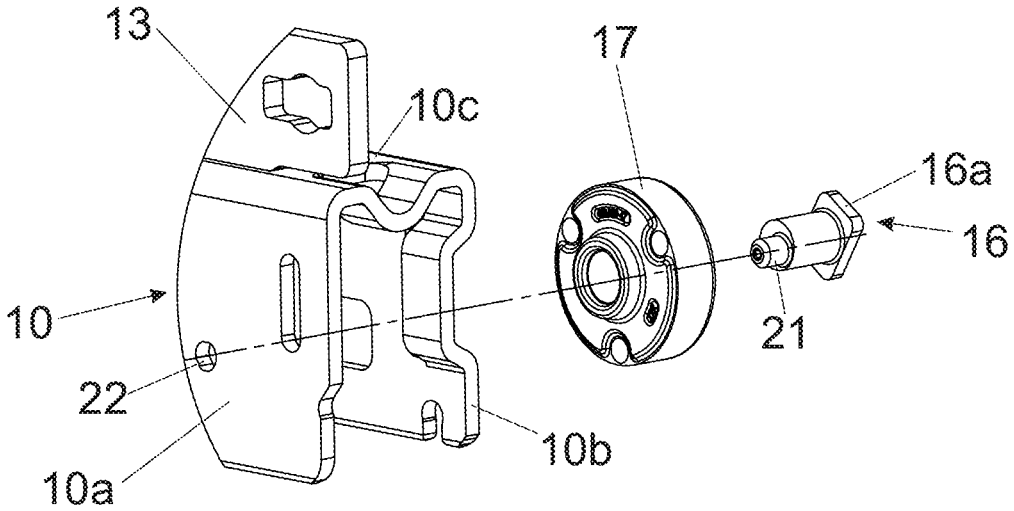

FIG. 4*b* shows the encircled region of FIG. 4*a* in an enlarged view. The first guide rail 10 includes a U-shaped profile having two side limbs 10*a*, 10*b* spaced from one another, the side limbs 10*a*, 10*b* being connected to one another by a transverse limb 10*c*. The supporting element 17, in the mounted position, is received between the two side limbs 10*a*, 10*b* of the first guide rail 10. The supporting element 17 can be fixed to the side limb 10*a* facing towards the fastening section 9*b* by the adjustment element 16*a* in the form of the eccentric. The adjustment element 16*a* includes a pin 21 engaging into a corresponding opening 22 of the first guide rail 10 in the mounted position. After adjustment of the position of the supporting element 17 relative to the first guide rail 10, the pin 21 of the adjustment element 16*a* can be permanently fixed to the first guide rail 10, for example by tumbling (radial riveting).

Figure 5A:
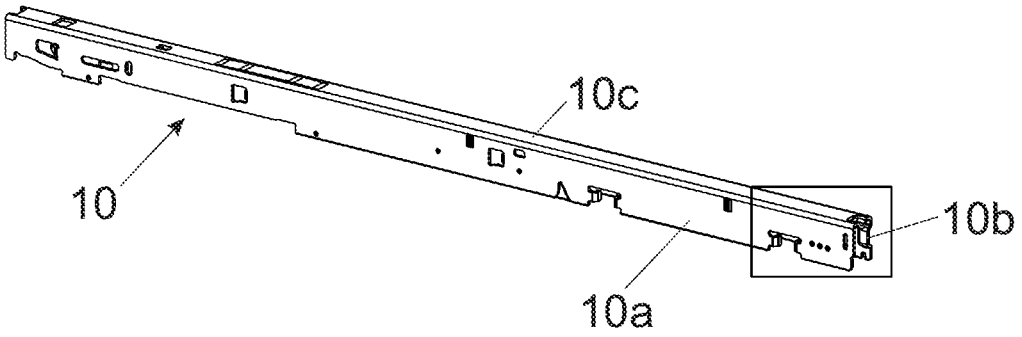
FIG. 5*a*-5*c* show a further embodiment of the invention with a plurality of openings for supporting the supporting element, the openings being spaced from one another in the height direction.
Figure 5B:
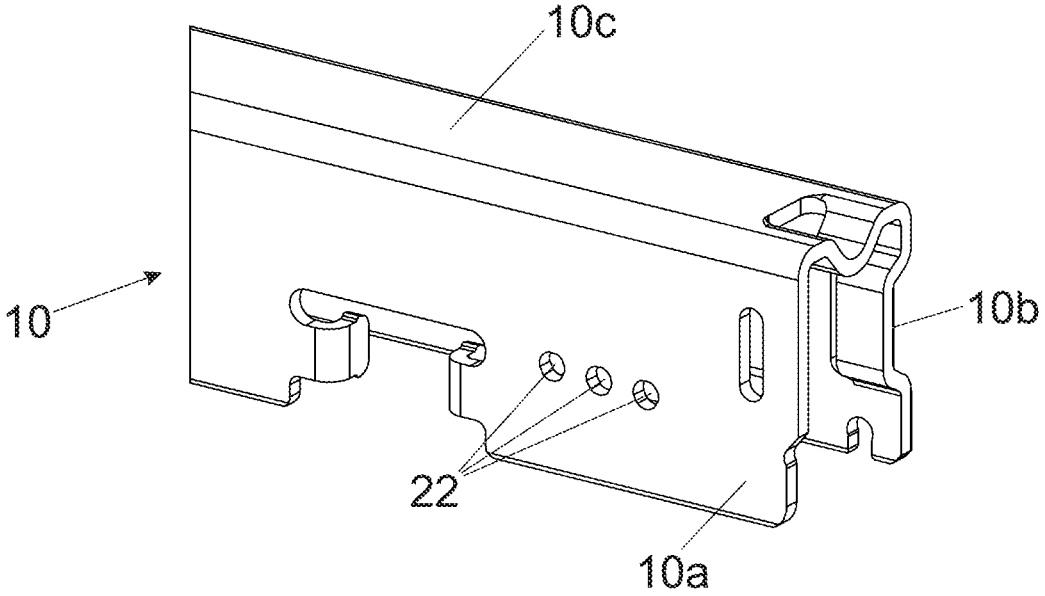
Figure 5C:
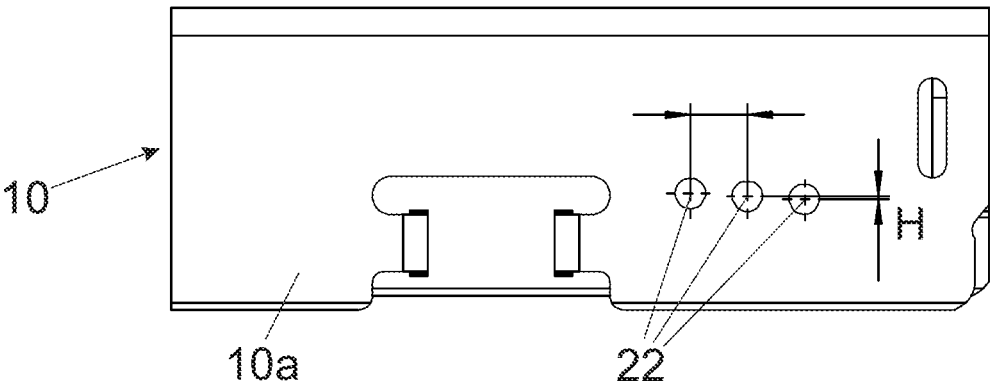

FIG. 5*a* shows a perspective view of the first guide rail 10 according to a further embodiment of the invention. FIG. 5*b* shows the framed region of FIG. 5*a* in an enlarged view. In this embodiment, the first guide rail 10 includes two or more openings 22 spaced from one another in the height direction (H), the openings 22 being provided for selectively receiving the supporting element 17. The supporting element 17 can be introduced in one of the openings 22 either directly via a pin 21, so that the supporting element 17 can adopt different height positions in order to adapt the play (X). Alternatively, also with this embodiment, the adjustment can be additionally performed by a movably-mounted adjustment element 16*a*. The play (X) between the supporting element 17 and the second guide rail 11 can thus be adjusted such that the pin 21 of the adjustment element 16*a* or of the supporting element 17 can be alternatively introduced in one of the openings 22 spaced from each other in the height direction (H) and is subsequently fixed. FIG. 5*c* shows a side view of the rear-end portion of the first guide rail 10 according to this embodiment. The openings 22 can be arranged offset relative to one another in the height direction (H), for example by 0.2 mm.

Figure 6A:
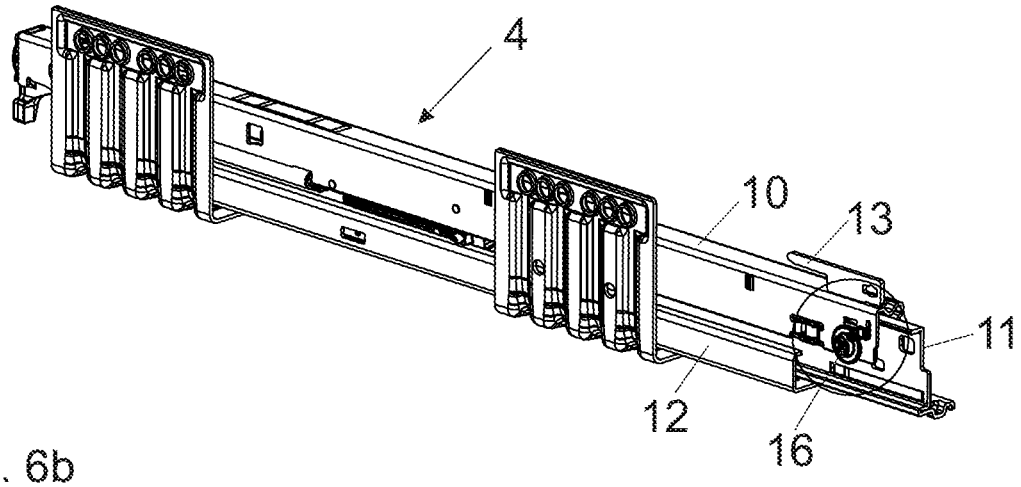
FIG. 6*a*-6*c* show a further embodiment of the invention with a rotatably-supported worm wheel for adjusting the play between the supporting element and the second guide rail.
Figure 6B:
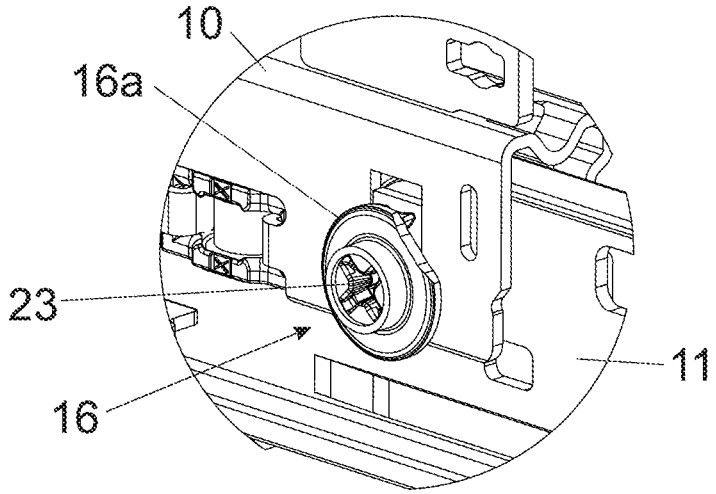
Figure 6C:
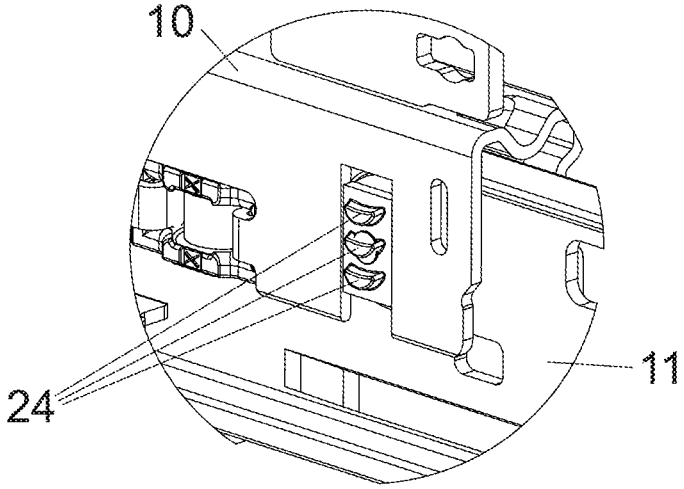

FIG. 6*a*-6*c* show a further embodiment of the invention, in which the adjustment device 16 for adjusting the play (X) between the supporting element 17 and the second guide rail 11 includes an adjustment element 16*a* in the form of a rotationally mounted worm wheel. FIG. 6*b* shows the encircled region of FIG. 6*a* in an enlarged view. The adjustment element 16*a* includes a receiving device 23 for receiving a tool, preferably a screwdriver, and a position of the supporting element 17 can be adjusted by rotating the receiving device 23 with the aid of the tool. On the back side of the adjustment element 16*a* in the form of a worm wheel, a spiral-shaped guide track, as commonly known, is arranged. The spiral-shaped guide track cooperates with a tooth arrangement 24 connected to the supporting element 17. The tooth arrangement 24 can be seen in FIG. 6*c*, in which the rotatably mounted adjustment element 16*a* is hidden. The adjustment element 16*a* in the form of the worm wheel, jointly with the tooth arrangement 24, forms a drive having a high level of self-locking, so that the position of the supporting element 17 does not alter upon an adjustment and upon a load of the drawer 3.

The invention claimed is:

1. A drawer pull-out guide, comprising:

a first guide rail and a second guide rail displaceably supported relative to one another; and a supporting element arranged on the first guide rail, the supporting element being configured to be supported, at least temporarily, on the second guide rail;

wherein a position of the supporting element relative to the second guide rail is adjustable by an adjustment device, and is fixable relative to the first guide rail after adjustment of the position has been made, wherein the supporting element is adjustable in a height direction by the adjustment device when the drawer pull-out guide is in the mounted position, wherein the adjustment device includes a movably-supported adjustment element configured to adjust a position of the supporting element, and wherein the adjustment element is rotationally supported to allow the position of the supporting element to be adjusted by a rotation of the adjustment element.

2. The drawer pull-out guide according to claim 1, wherein the guide rails are configured to be displaceable relative to one another between a closed position and an open position, wherein the supporting element has a play in relation to the second guide rail at least in the closed position, the adjustment device being configured to adjust the play.

3. The drawer pull-out guide according to claim 2, wherein an amount of the play in the open position is smaller than an amount of the play in the closed position, and/or the supporting element bears against the second guide rail without play in the open position.

4. The drawer pull-out guide according to claim 1, wherein the adjustment device has a self-locking configuration.

5. The drawer pull-out guide according to claim 1, further comprising a securing element configured to fix the position of the supporting element after adjustment.

6. The drawer pull-out guide according to claim 1, wherein the supporting element is a rotationally mounted supporting roller.

7. The drawer pull-out guide according to claim 1, wherein the supporting element is arranged on a rear-end region of the first guide rail.

8. A drawer pull-out guide, comprising:

a first guide rail and a second guide rail displaceably supported relative to one another; and a supporting element arranged on the first guide rail, the supporting element being configured to be supported, at least temporarily, on the second guide rail;

wherein a position of the supporting element relative to the second guide rail is adjustable by an adjustment device, and is fixable relative to the first guide rail after adjustment of the position has been made, wherein the supporting element is adjustable in a height direction by the adjustment device when the drawer pull-out guide is in the mounted position, wherein the adjustment device includes a movably-supported adjustment element configured to adjust a position of the supporting element, and wherein the adjustment element includes a rotationally supported eccentric or a rotationally supported worm wheel.

9. A drawer pull-out guide, comprising:

a first guide rail and a second guide rail displaceably supported relative to one another; and a supporting element arranged on the first guide rail, the supporting element being configured to be supported, at least temporarily, on the second guide rail;

wherein a position of the supporting element relative to the second guide rail is adjustable by an adjustment device, and is fixable relative to the first guide rail after adjustment of the position has been made, wherein the supporting element is adjustable in a height direction by the adjustment device when the drawer pull-out guide is in the mounted position, wherein the adjustment device includes a movably-supported adjustment element configured to adjust a position of the supporting element, and wherein the adjustment element co-operates with a tooth arrangement connected to the supporting element.

10. A drawer pull-out guide, comprising:

a first guide rail and a second guide rail displaceably supported relative to one another; and a supporting element arranged on the first guide rail, the supporting element being configured to be supported, at least temporarily, on the second guide rail;

wherein a position of the supporting element relative to the second guide rail is adjustable by an adjustment device, and is fixable relative to the first guide rail after adjustment of the position has been made, wherein the supporting element is adjustable in a height direction by the adjustment device when the drawer pull-out guide is in the mounted position, and wherein the first guide rail includes two or more openings spaced from one another in the height direction, the two or more openings being configured to selectively receive the supporting element.

11. A drawer pull-out guide, comprising:

a first guide rail and a second guide rail displaceably supported relative to one another; and a supporting element arranged on the first guide rail, the supporting element being configured to be supported, at least temporarily, on the second guide rail;

wherein a position of the supporting element relative to the second guide rail is adjustable by an adjustment device, and is fixable relative to the first guide rail after adjustment of the position has been made, wherein the supporting element is adjustable in a height direction by the adjustment device when the drawer pull-out guide is in the mounted position, and wherein the position of the supporting element permanently fixable after adjustment by welding, bonding or tumbling.

12. A drawer pull-out guide, comprising:

a first guide rail and a second guide rail displaceably supported relative to one another; and a supporting element arranged on the first guide rail, the supporting element being configured to be supported, at least temporarily, on the second guide rail;

wherein a position of the supporting element relative to the second guide rail is adjustable by an adjustment device, and is fixable relative to the first guide rail after adjustment of the position has been made, wherein the supporting element is adjustable in a height direction by the adjustment device when the drawer pull-out guide is in the mounted position, and wherein the second guide rail includes a side limb and a transverse limb connected to the side limb, wherein the supporting element is arranged to be supported on an underside of the transverse limb of the second guide rail in the mounted position of the drawer pull-out guide, wherein the transverse limb is flat over an entire length thereof.

13. A drawer pull-out guide, comprising:

a first guide rail and a second guide rail displaceably supported relative to one another; and a supporting element arranged on the first guide rail, the supporting element being configured to be supported, at least temporarily, on the second guide rail;

wherein a position of the supporting element relative to the second guide rail is adjustable by an adjustment device, and is fixable relative to the first guide rail after adjustment of the position has been made, wherein the supporting element is adjustable in a height direction by the adjustment device when the drawer pull-out guide is in the mounted position, and wherein the drawer pull-out guide further comprises a running carriage with load-transmitting rolling bodies between the first guide rail and the second guide rail.

14. A method for mounting a supporting element to a drawer pull-out guide, the drawer pull-out guide including:

a first guide rail and a second guide rail displaceably supported relative to one another; and a supporting element arranged on the first guide rail, the supporting element being configured to be supported, at least temporarily, on the second guide rail;

wherein a position of the supporting element relative to the second guide rail is adjustable by an adjustment device, and is fixable relative to the first guide rail after adjustment of the position has been made, and wherein the supporting element is adjustable in a height direction by the adjustment device when the drawer pull-out guide is in the mounted position, wherein, the method comprises:

arranging the supporting element on the first guide rail of the drawer pull-out guide, adjusting the supporting element at a predetermined position relative to the second guide rail with the aid of the adjustment device, and fixing the supporting element relative to the first guide rail, wherein the supporting element is moved in a first movement direction for adjusting the predetermined position when the supporting element abuts against the second guide rail, and is moved back in a second movement direction opposite the first movement direction until the predetermined position is reached.

* * * * *